United States Patent [19]

Kageyama et al.

[11] Patent Number: 5,033,880

[45] Date of Patent: Jul. 23, 1991

[54] PRINTER WITH CHARACTER EXPANSION IN ACCORDANCE WITH LINE PITCH

[75] Inventors: Seiji Kageyama, Fuchu; Tomohiko Yanagita; Junichi Enomoto, both of Hitachi, all of Japan

[73] Assignee: Hitachi, Ltd., Tokyo, Japan

[21] Appl. No.: 200,910

[22] Filed: Jun. 1, 1988

[30] Foreign Application Priority Data

Jun. 1, 1987 [JP] Japan ..... 62-134866

[51] Int. Cl.[5] ..... B41J 19/96

[52] U.S. Cl. ..... 400/76; 400/121; 400/555; 400/582

[58] Field of Search ..... 400/76, 121, 279, 568, 400/582, 583, 611, 902, 555; 364/900

[56] References Cited

U.S. PATENT DOCUMENTS

| | | | |
|---|---|---|---|
| 4,311,399 | 1/1982 | Wegryn et al. | 400/76 |
| 4,484,826 | 11/1984 | Horn et al. | 400/279 |
| 4,488,827 | 12/1984 | Haganuma | 400/121 |
| 4,546,449 | 10/1985 | Masaki et al. | 364/900 |
| 4,655,622 | 4/1987 | Aoki | 400/121 |
| 4,698,624 | 10/1987 | Barker et al. | 400/76 X |
| 4,707,153 | 11/1987 | Nishi et al. | 400/76 X |
| 4,804,280 | 2/1989 | Kurokawa | 400/555 |

FOREIGN PATENT DOCUMENTS

| | | | |
|---|---|---|---|
| 3436811 | 4/1986 | Fed. Rep. of Germany | 400/76 |
| 109765 | 8/1981 | Japan | 400/124 |
| 131085 | 8/1983 | Japan | 400/555 |
| 0156783 | 9/1984 | Japan | 400/121 |
| 0032691 | 2/1985 | Japan | 400/611 |
| 0079984 | 5/1985 | Japan | 460/568 |
| 0129266 | 7/1985 | Japan | 400/121 |
| 0217186 | 10/1985 | Japan | 400/76 |

OTHER PUBLICATIONS

IBM Technical Disclosure Bulletin, "Periodic Vertical Spacing in Text", Hofmeister, vol. 26, No. 4, Sep. 1983, pp. 2146–2147.

IBM Technical Disclosure Bulletin, "Line Spacing Between Successive Lines of Fonts Having Differing Heights", Delaplain et al, vol. 27, No. 4B, Sep. 1984, p. 2374.

*Primary Examiner*—David A. Wiecking
*Assistant Examiner*—Steven S. Kelley
*Attorney, Agent, or Firm*—Antonelli, Terry, Stout & Kraus

[57] ABSTRACT

In a controller for use in a printer, when line pitch information is set in a printer status storage unit by way of a line pitch setter, a distance setter determines a cursor/base line distance on the basis of the line pitch information, and a character pattern expander determines a base line from the cursor/base line distance, expands a dot pattern of a printing character in reference to the base line position and stores the expanded dot pattern in a buffer memory.

6 Claims, 9 Drawing Sheets

PRINTER WITH CHARACTER EXPANSION IN ACCORDANCE WITH LINE PITCH

BACKGROUND OF THE INVENTION

This invention relates to printers and more particularly to a controller for use in various printers in which the pitch between adjacent printing lines can be changed.

When printing text information on a cut sheet of paper and delivering the information by using a printer, layout information indicative of paper size, upper/-lower and right/left margins, line pitch and the like is set in an internal controller and the printer is operated to print and deliver the text information in accordance with the layout information. The line pitch is increased for the sake of printing a larger character and is decreased for printing a smaller character so that the printing layout can be balanced. The line pitch information is set in accordance with instructions by the operator.

As exemplarily shown in FIG. 2, the printer is supplied with the line pitch information indicative of a left upper end point 21 of a printable area 20 on a cut sheet and a cursor position 22 at the first line and first column on a character series. The left upper point 21 takes a value specific to the printer which is predetermined for various paper sizes including JIS (Japanese Industrial Standards) A4 size and postal size. The cursor position 22 is determined when commands representative of a text write area and upper/lower and right/left margins are supplied from a host computer to the printer. With the cursor positioned as indicated at reference numeral 22, commands representative of information about a line pitch Lp and a column pitch (character pitch) Cp are transmitted from the host computer and set in the printer under manipulation of the operator to establish a cursor coordinate system referenced to the current cursor position 22 on the basis of the current cursor position 22, line pitch Lp and column pitch Cp. For example, a point denoted by reference numeral 23 indicates a cursor position at i-th line and j-th column ($i=2$, $j=3$). Then, a position 24 is set which is offset by a predetermined distance $\delta y$ from each of the cursor positions 22 and 23 and a base line 25 referenced to the position 24 is set. Hereinafter, the predetermined distance $\delta y$ will be referred to as cursor/base line distance and the position 24 as base line reference position.

Dot patterns of printing characters 29 and 30 are expanded in reference to the base line reference position 24, with the result that the character 29 is so printed as to lie on the base line 25 and the character 30 is so printed as to be lowered by a predetermined amount from the base line 25.

Generally, the printer is operated to print in accordance with instructions from the host computer such as a personal computer. Individual printing character patterns are printed on printing paper pursuant to a printing layout, the majority of which is determined by the host computer and thus the printer has a smaller degree of freedom and versatility in determining the layout. More specifically, in the conventional printer, when a line pitch setting command representative of line pitch information issued from the host computer is received, a fixed cursor/base line distance $\delta y$ is set irrespective of the value of line pitch.

For example, JP-A-58-158685 discloses printing control in a printer.

Since the conventional printer always sets the cursor/base line distance to a fixed value irrespective of the magnitude of line pitch, it faces the following problems when the line pitch is changed to change the size of printing character.

More particularly, when, in a printer constructed so as to keep the balance of the printing layout as shown in FIG. 3*a*, a larger line pitch Lp is set as shown in FIG. 3*b* for the sake of printing larger characters, the fixed cursor/base line distance $\delta y$ causes an upper portion of printing character patterns on the first line to protrude from the upper margin or to protrude through the margin region, thereby disturbing the printing balance or overriding printing.

Conversely, when a smaller line pitch Lp is set as shown in FIG. 3*c* for the sake of printing smaller characters over a large number ($M=8$ lines) of lines, the cursor/base line distance $\delta y$ becomes larger than the line pitch with the result that a margin 31 above a printing character series on the first line is excessively widened and the number N of lines on which normal printing is permitted is limited to 7, and therefore $N<M$ and equality between N and M is not achieved.

SUMMARY OF THE INVENTION

An object of this invention is to provide a printer capable of automatically changing the base line reference position to which the expansion of dot patterns of printing characters is referenced to thereby print characters in balanced printing layout even when the line pitch is changed to change the size of characters to be printed.

According to the invention, in a printer comprising a printer status storage unit for storing information indicative of the internal status of the printer, a line pitch setting unit for setting line pitch information indicative of values of the line pitch following the cursor position in the printer status storage unit, and a character pattern expanding unit for expanding a character code received from a host computer into a dot pattern in accordance with the line pitch information stored in the printer status storage unit, the line pitch setting unit includes line pitch setting means for setting the line pitch information in the printer status storage unit and distance setting means for determining a cursor/base line distance in accordance with the line pitch information stored in the printer status storage unit and setting the determined distance in the printer status storage unit, and the character pattern expanding unit includes, character pattern expanding means for setting a base line position at a location which is offset from the cursor position by the cursor/base line distance in the direction in which the number of lines increases and expanding the dot pattern in reference to the base line position.

When the line pitch information is set in the printer status storage unit by means of the line pitch setting means, the distance setting means determines the cursor/base line distance on the basis of the line pitch information and the character pattern expanding unit determines the base line from the cursor/base line distance and expands the dot pattern of printing character in reference to the base line, thereby ensuring that characters can be printed in accordance with their size in a balanced layout.

DESCRIPTION OF THE PREFERRED EMBODIMENTS

The invention will now be described by way of example with reference to the accompanying drawings.

Figure 1A:
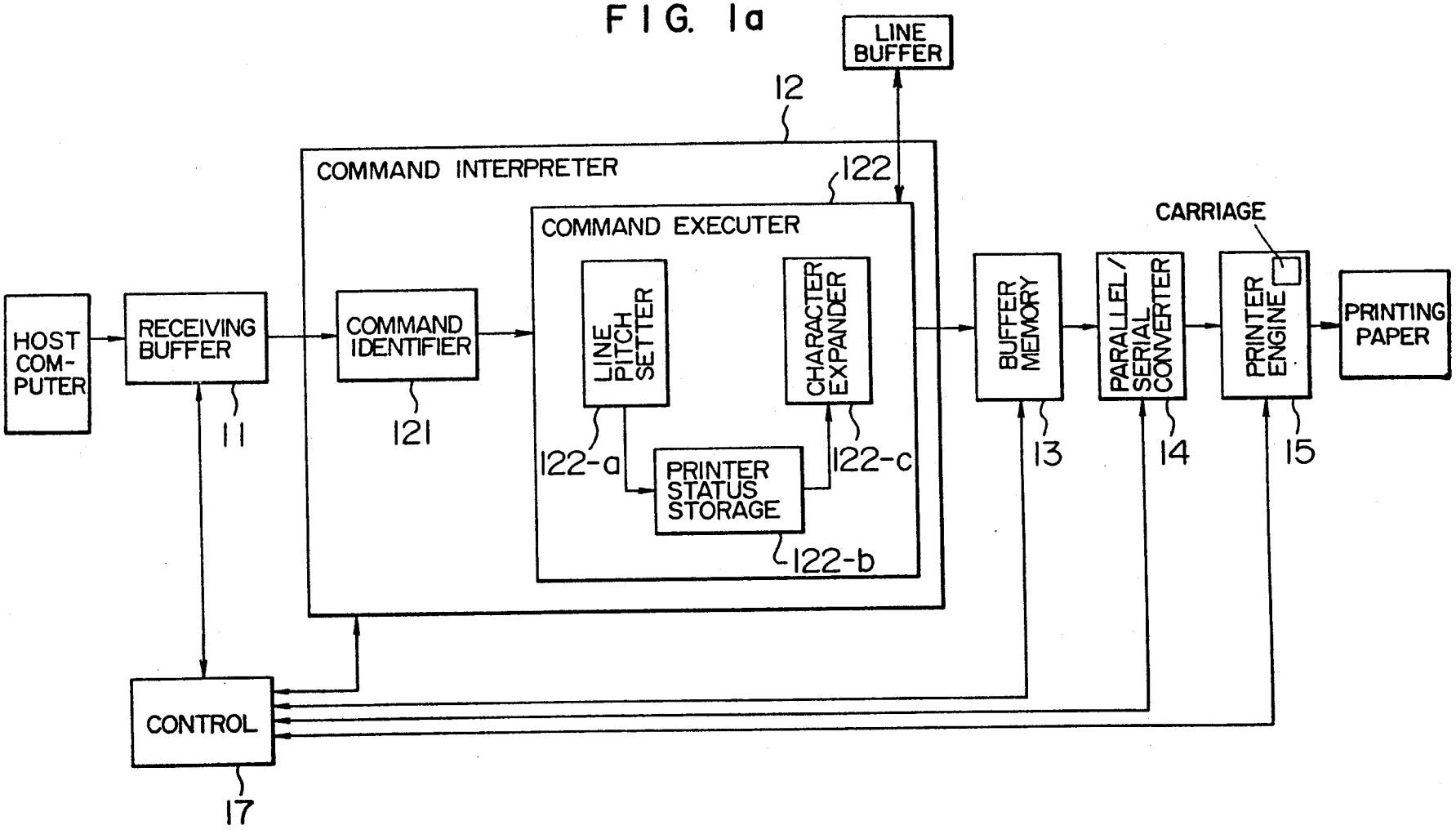
FIG. 1*a* is a block diagram illustrating a printing controller in a printer according to an embodiment of the invention.

Referring to FIG. 1*a*, there is illustrated, in block form, a printing controller according to an embodiment of the invention. The printing controller comprises a receiving buffer unit 11, a command interpreter 12, a buffer memory unit 13, a parallel/serial converter unit 14, a printer engine unit 15 and a control unit 17.

The command interpreter 12 includes a command identifier unit 121 and a command executer unit 122 which is comprised of a line pitch setting unit 122-a, a printer status storage unit 122-b and a character expanding unit 122-c.

Printing control processing procedure in each unit executed under the control of the control unit 17 will now be described with reference to FIGS. 5*a* to 5*e*.

Figure 5A:
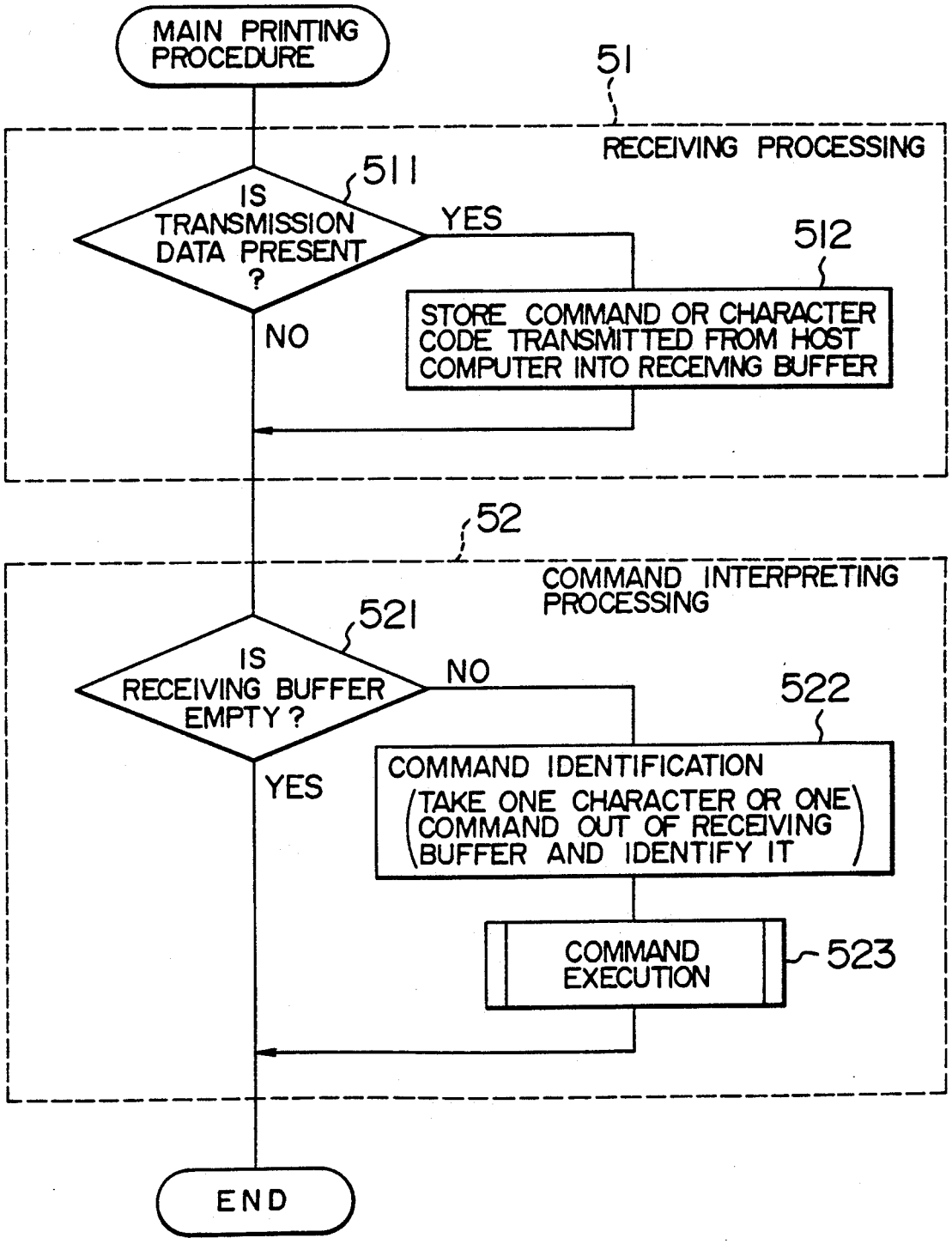
FIGS. 5*a*, 5*b*, 5*c*, 5*d* and 5*e* are flow charts showing printing control procedure.

The printing control procedure mainly includes receiving processing 51 and command interpreting processing 52, as shown in FIG. 5*a*. In the receiving processing 51, it is decided in step 511 whether transmission data from the host computer is present. If absent, the procedure proceeds directly to the command interpreting processing 52. If present, the procedure proceeds to the processing 52 through step 512 in which a command or a character code (hereinafter referred to as received contents) transmitted from the host computer is received and stored in the receiving buffer unit 11.

In the command interpreting processing 52, the received contents in the receiving buffer unit 11 are sequentially read and expanded into a character dot pattern which in turn is written in the buffer memory unit 13, and the data in parallel form in the buffer memory unit 13 is converted by the parallel/serial converter unit 14 into a video signal in serial form to be delivered to the printer engine unit 15 which responds to the video signal to print a character pattern on printing paper. Specifically, it is decided in step 521 whether the receiving buffer unit 11 is empty and, if empty, the main printing control procedure ends. If not empty, the procedure proceeds to command executing step 523 through step 522 in which the received contents are taken out of the receiving buffer unit 11 and subjected to identification.

Figure 5B:
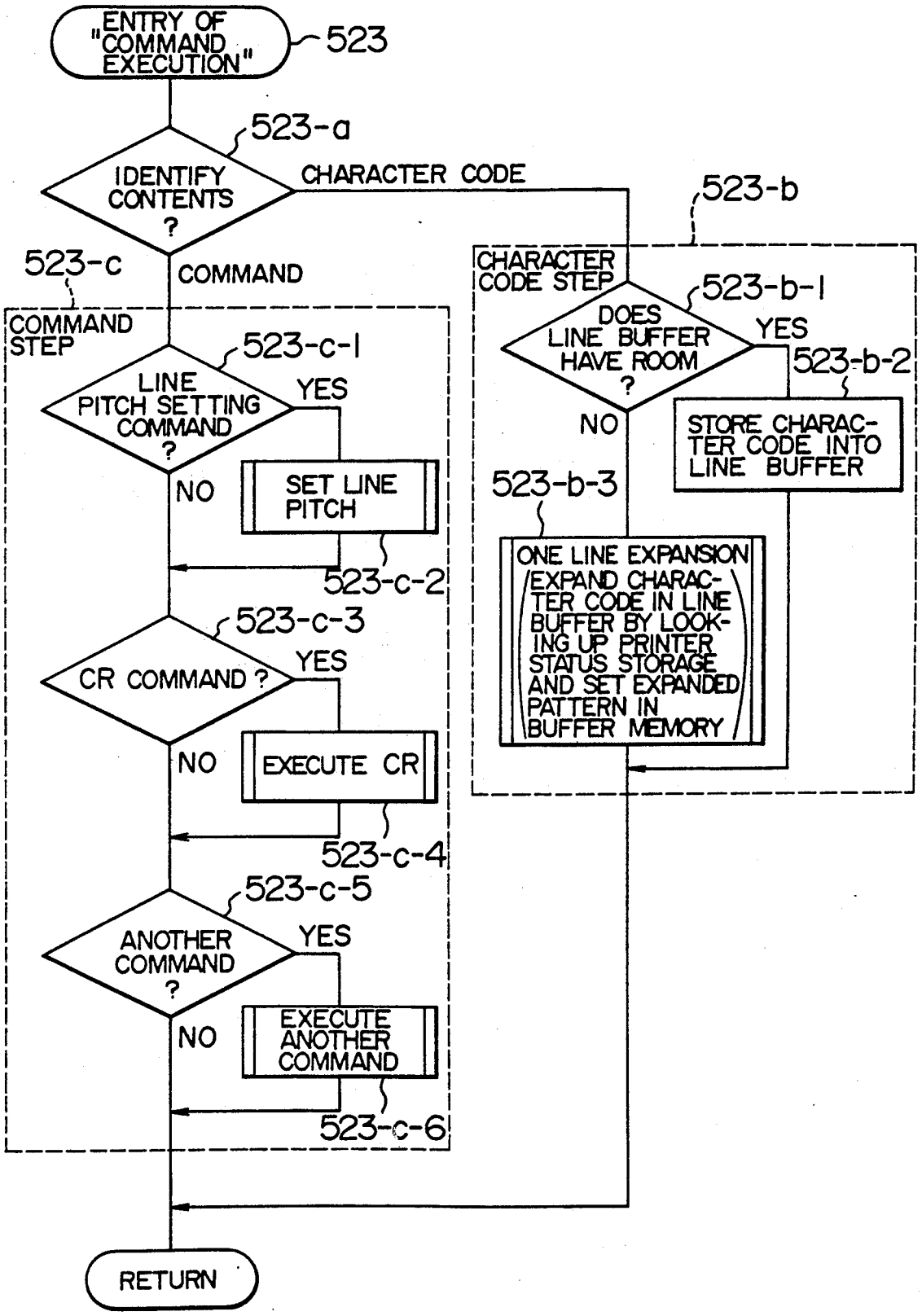

In the command executing step 523, as shown in FIG. 5*b*, it is decided in step 523-a whether the received contents are identified as character code or command code. If the received contents are identified as a character code, the procedure proceeds to character code step 523-b and if identified as a command code, the procedure proceeds to command step 523-c. In the character code step 523-b, it is first decided in step 523-b-1 whether a line buffer (not shown) has room and, if it has room, the procedure proceeds to step 523-b-2 in which the character code is stored in the line buffer. If the line buffer has no room, the procedure proceeds to step 523-b-3 in which the character code in the line buffer is sequentially expanded into a character dot pattern by looking up the contents of the printer status storage unit 122-b, and the character dot pattern is stored in the buffer memory unit 13.

Figure 5C:
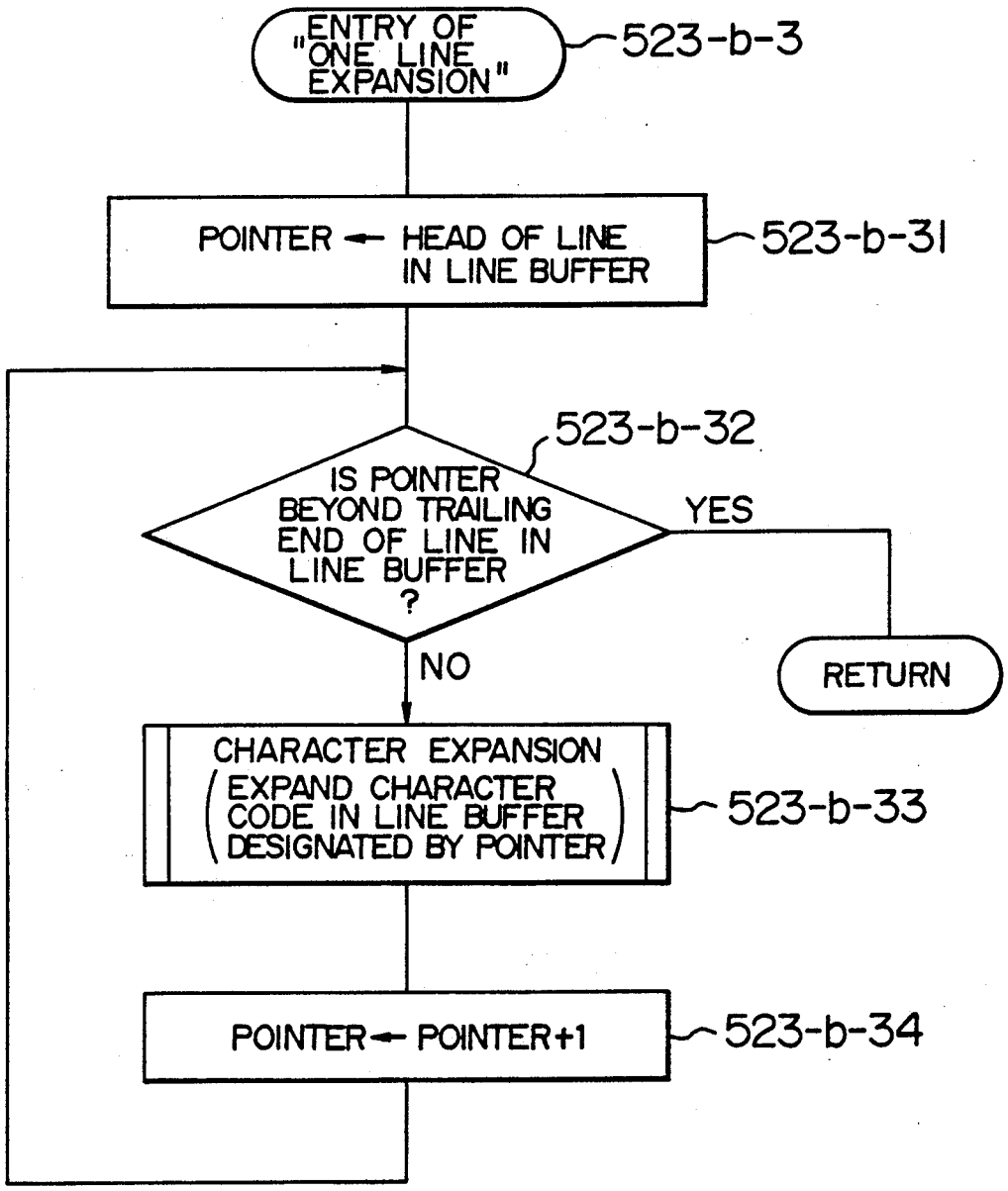

FIG. 5*c* shows details of processing procedure in the step 523-b-3. In step 523-b-31, the pointer is moved to the head of line in the line buffer and in step 523-b-32, it is decided whether the pointer is beyond the trailing end of line in the line buffer. If not, the procedure proceeds to step 523-b-33 in which a character code in the line buffer which is designated by the pointer is expanded into a dot pattern and then returns to the step 523-b-32 through step 523-b-34 in which the pointer is incremented. By repeating this processing routine, character codes for one line can be expanded into dot patterns.

When the received contents are identified as a command code in the step 523-a of FIG. 5*b*, the procedure proceeds to the command step 523-c in which a command processing is executed. It is first decided in step 523-c-1 whether the command code is a line pitch setting command and if "YES", line pitch setting step 523-c-2 is executed. If "NO", the procedure proceeds to step 523-c-3 in which it is decided whether the command code is a carriage return (CR) command. If "YES", CR executing step 523-c-4 is executed. If "NO", another type of command is decided in step 523-c-5 and executed in step 523-c-6.

Figure 5D:
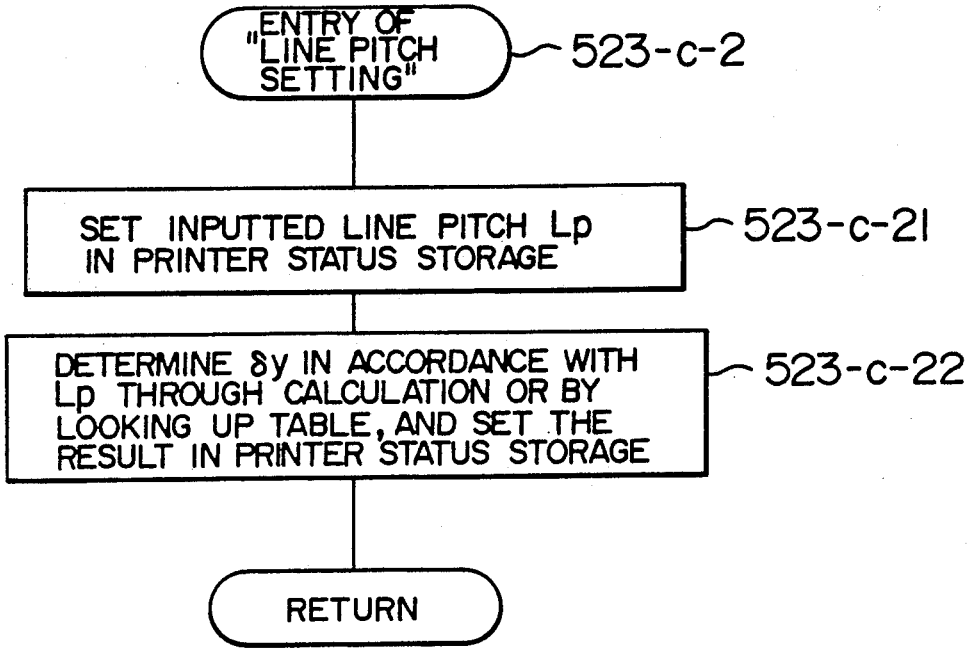

FIG. 5*d* shows details of processing procedure in the line pitch setting step 523-c-2. In step 523-c-21, information indicative of an inputted line pitch Lp is set in the printer status storage unit 122-b. In step 523-c-22, a cursor/base line distance $\delta y$ complying with the line pitch Lp is calculated or determined by looking up a table and set in the printer status storage unit 122-b. In the present embodiment, the cursor/base line distance $\delta y$ is calculated as shown by the following formula as a linear function of line pitch Lp:

$$\delta y = a \cdot Lp + b$$

where a=0.75 and b=0.

Figure 5E:
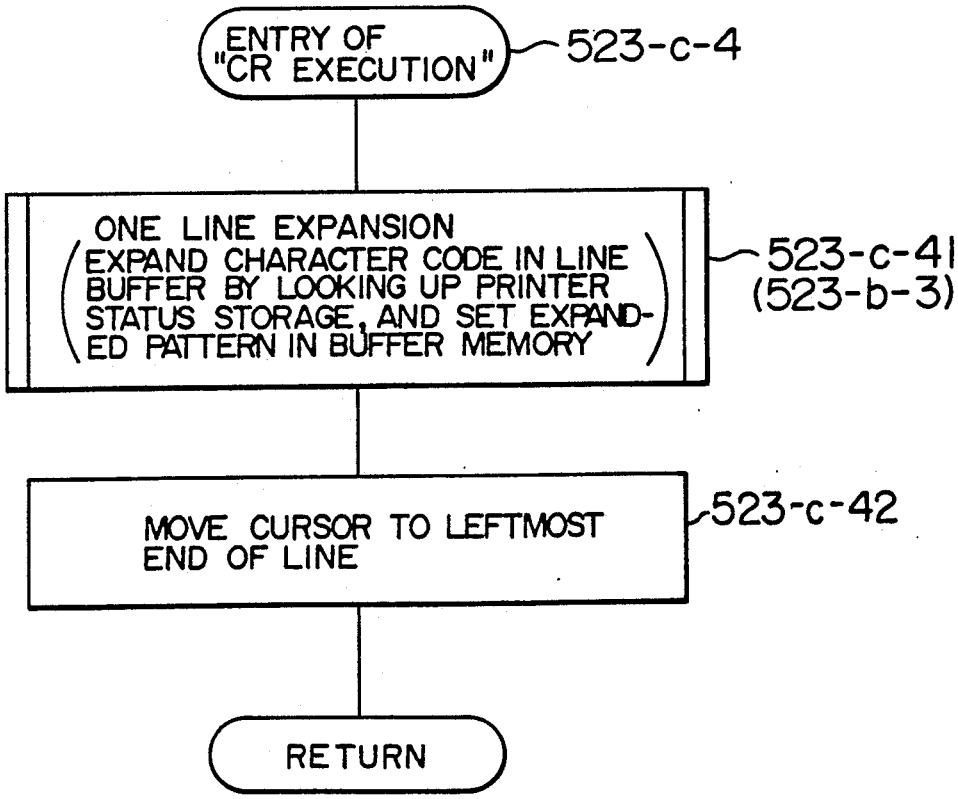

FIG. 5*e* shows details of processing procedure in the CR executing step 523-c-4. Upon start of this step, the carriage of the printer is returned and the aforementioned step 523-b-33 is called in step 523-c-41. In this called step 523-b-33, a base line reference position 24 is determined by referring to a current cursor position 22 or 23 and the information indicative of the cursor/base line distance $\delta y$ which is stored in the printer status storage unit 122-b and a character dot pattern is expanded in reference to the base line reference position. The processing then proceeds to step 523-c-4 to perform the moving of the cursor to the leftmost end of the line after one line expansion of character data has been completed.

Figure 3A:
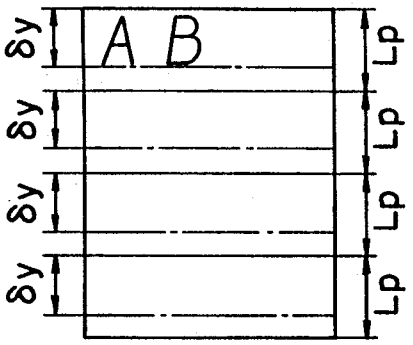
Figure 3B:
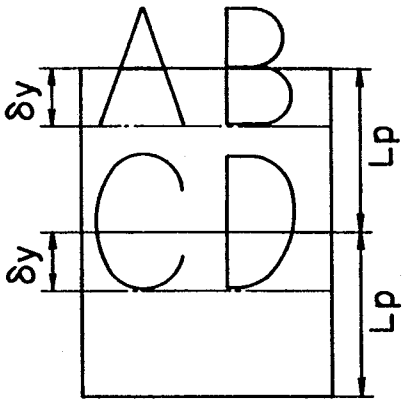
FIG. 3b PRIOR ART
Figure 3C:
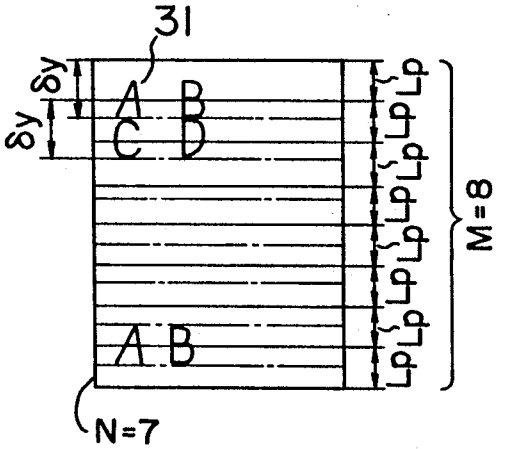
FIG. 3c PRIOR ART
Figure 4A:
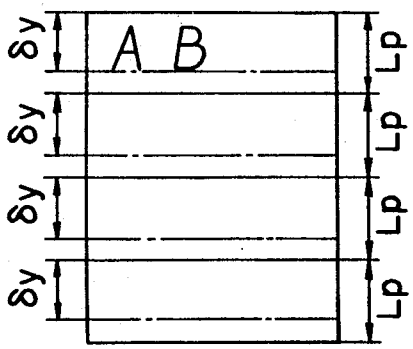
Figure 4B:
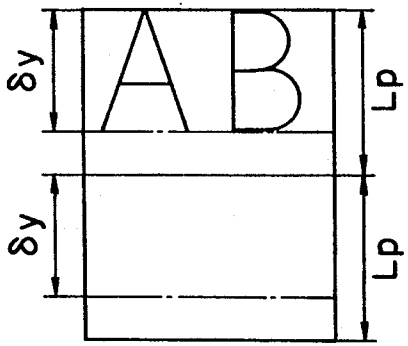
Figure 4C:
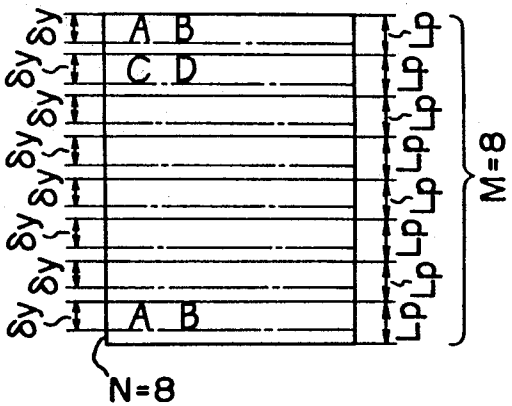

Of FIGS. 4*a* to 4*c* illustrating examples of the layout of characters printed through printing control described as above, FIG. 4*a* shows an example of printed characters of standard size, FIG. 4*b* shows an example of printing of characters being larger than the standard size, and FIG. 4*c* shows an example of printing of characters being smaller than the standard size. FIG. 4*c* corresponds to FIG. 3c in that the number M of lines equals 8, yet FIG. 4c differs from FIG. 3c in that the number N of lines on which printing is permitted also equals 8. Thus, in the prior art of FIG. 3 N<M, while in the present invention, as illustrated in FIG. 4, N can equal M. It will be appreciated that in FIGS. 4a to 4c, characters are printed in a balanced layout in accordance with the information indicative of a set line pitch Lp.

Figure 1B:
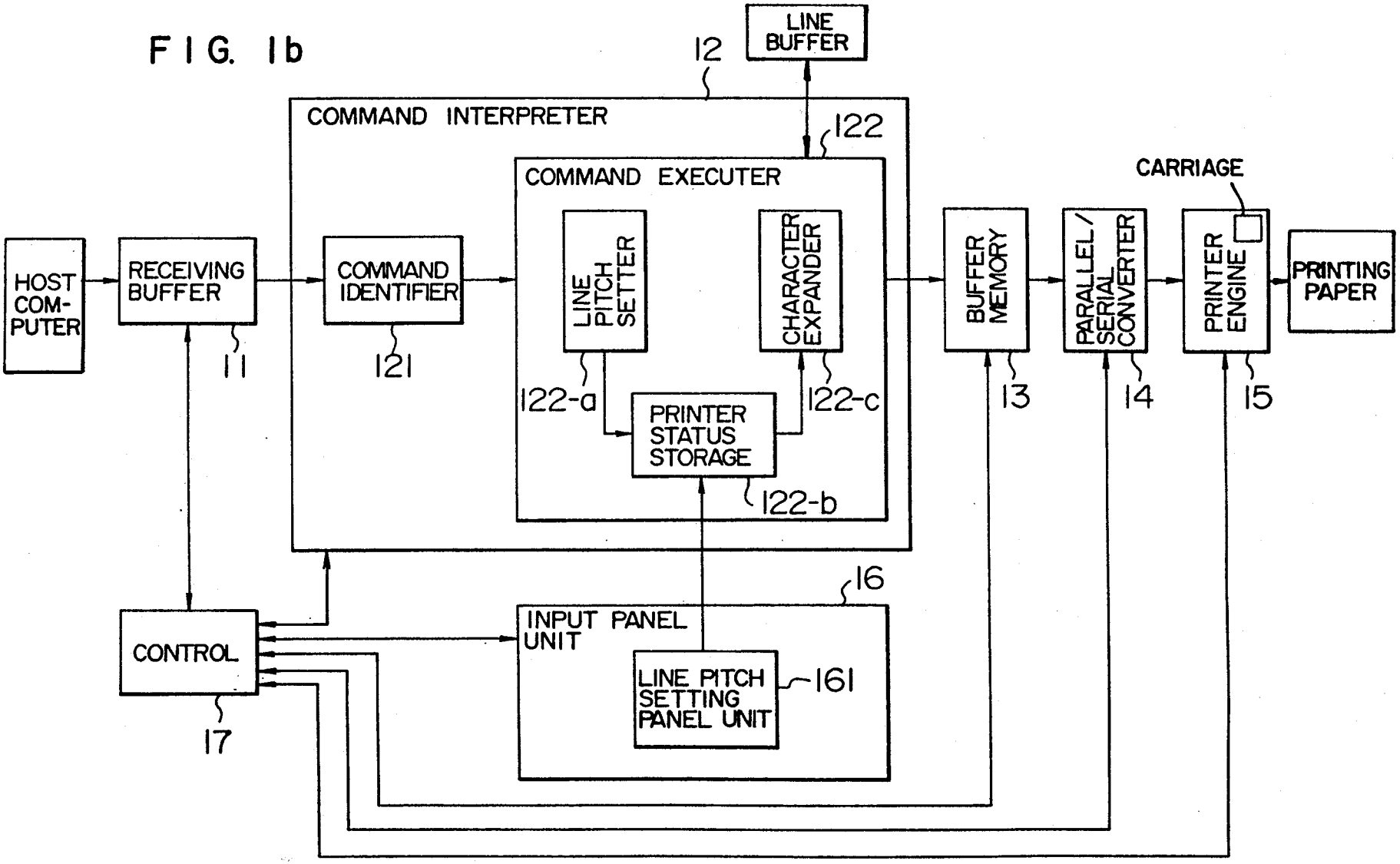
FIG. 1*b* is a block diagram illustrating another embodiment of a printing controller according to the invention.

FIG. 1b illustrates, in block form, another embodiment of the printing controller of the invention. FIG. 1b embodiment is different from the first embodiment of FIG. 1a in that there is provided an input panel unit 16 for setting line pitch information. The input panel unit 16 includes a line pitch setting panel unit 161. When line pitch information is inputted by the operator through panel manipulation, the line pitch setting panel unit 161 writes in the printer status storage unit 122-b the information indicative of a line pitch Lp and information indicative of a cursor/base line distance δy determined on the basis of the line pitch Lp.

Part of the setting processing by the line pitch setting panel unit 161 may be modified so as to be handled by the line pitch setting unit 122-a included in the command executing unit 122. When the command from the host computer overlaps the command from the input panel unit 16, the controller unit 17 manages to determine the sequence of processing and no inconvenience occurs.

The invention has been described by way of two embodiments but it may be put into practice in modified forms as below.

Figure 2:
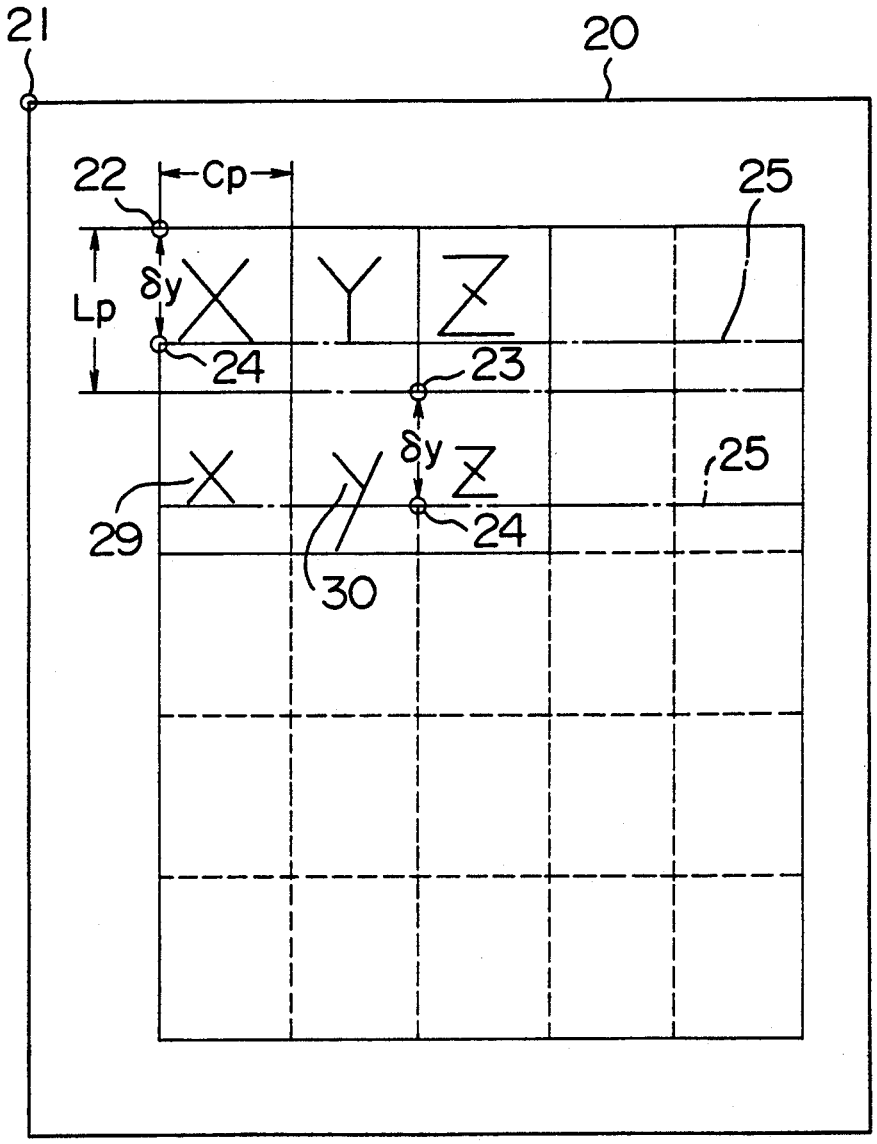
FIG. 2, FIGS. 3*a*, 3*b* and 3*c* and FIGS. 4*a*, 4*b* and 4*c* are diagrams illustrating and explaining various types of printing.

(1) The cursor position at the i-th line and j-th column, as represented by position 22 or 23 in FIG. 2, is otherwise set at position 24.

Figure 6B:
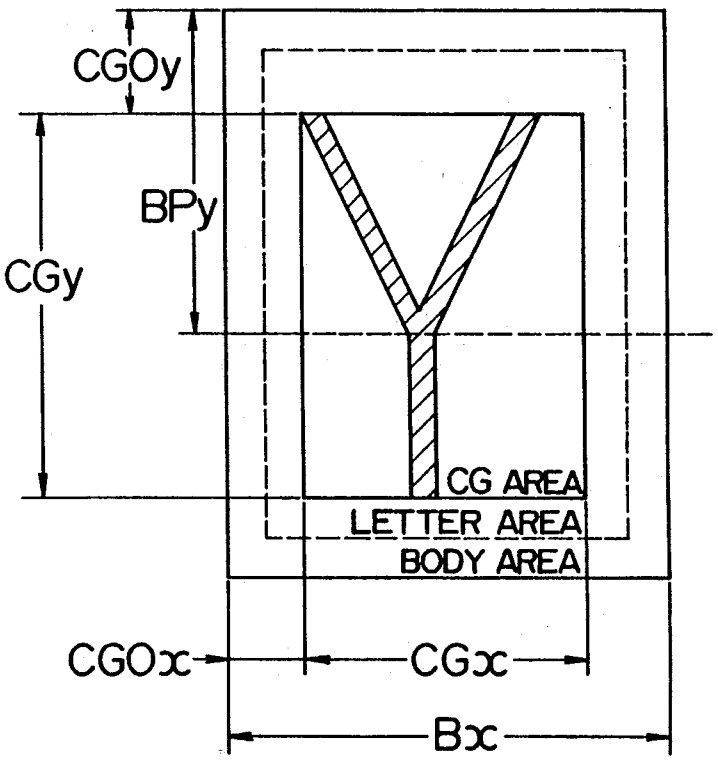
FIGS. 6*a* and 6*b* are diagrams for explaining the size of a font.
Figure 6A:
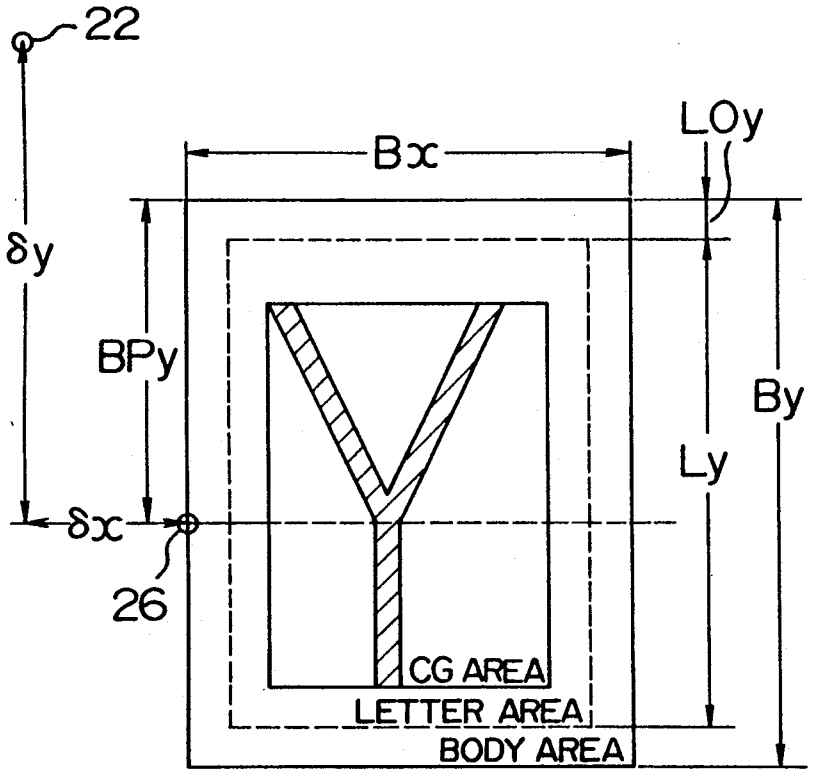

(2) The cursor/base line distance δy is determined in consideration of other factors than the line pitch information, for example, the paper size and the kind and size of font. The size of font is determined in accordance with parameters as shown in FIGS. 6a and 6b. Especially, FIG. 6a shows parameters used which are common to a set of fonts and FIG. 6b shows parameters which are different for different fonts and of which the character width is constant in the case of fixed pitch system but is different for different fonts in the case of a proportional system. In FIGS. 6a and 6b, Bx designates the body area width, By the body area height, Ly the letter area height, BPy the height from the reference position of the body area to the upper edge of the body area, LOy the letter area upper offset, CGy the CG area height, CGOy the CG area upper offset, CGx the CG area width, CGOx the CG area left offset, and $\delta_x$ the distance between the cursor position 22 and the reference position 26 in the direction of character width.

(3) Control in the direction in which the number of columns increases is effected on the basis of the information indicative of column pitch Cp, similar to control in the direction in which the number of lines increase is effected on the basic of the information indicative of line pitch Lp.

(4) The cursor/base line distance δy is determined from a quadratic function of line pitch Lp or from another function thereof.

As described above, according to the invention, when the line pitch information is set in the printer status storage unit 122-b by means of the line pitch setting means, the distance setting means determines the cursor/base line distance on the basis of the line pitch information and the character pattern expanding means determines the base line position from the cursor/base line distance and expands the dot pattern of the printing character in reference to the base line position, whereby the base line reference position to which the dot pattern expansion is referenced can be changed automatically to print characters in a balanced layout.

We claim:

1. A printer comprising:

a printer status storage unit for storing information indicative of the internal status of said printer;

a line pitch setting unit for setting line pitch information indicative of line pitch values related to a cursor position in said printer status storage unit; and a character pattern expanding unit for expanding a character code received from a host computer into a dot pattern in accordance with the line pitch information set in said printer status storage unit;

said line pitch setting unit including line pitch setting means for setting the line pitch information in said printer status storage unit and distance setting means for determining a cursor to base line distance in accordance with the line pitch information set in said printer status storage unit and for setting the determined line distance in said printer status storage unit;

said character pattern expanding unit including character pattern expanding means for setting a base line position at a location which is offset from the cursor position by the cursor to base line distance in a direction in which a number of lines increases and for expanding the dot pattern in reference to the base line position.

2. A printer according to claim 1, wherein said line pitch setting means sets the line pitch information in said printer status storage unit in accordance with a command received from the host computer.

3. A printer according to claim 1, wherein said line pitch setting means sets the line pitch information in said printer status storage unit in accordance with a command received from an input panel unit provided in said printer.

4. A printer according to claim 1, wherein said distance setting means determines the cursor to base line distance as a linear function of line pitch.

5. A printer according to claim 1, wherein said distance setting means determines the cursor to base line distance by looking up in a tale a cursor to base line distance value corresponding to the line pitch information set in said printer status storage unit.

6. A printer according to claim 1, wherein said distance setting means determines the cursor to base line distance in accordance with the following equation:

$$\delta_y = a \cdot L_p + b,$$

where $\delta_y$=the cursor to base line distance, a=0.75, and b=a constant.

* * * * *